US010104909B2

(12) United States Patent
Han et al.

(10) Patent No.: US 10,104,909 B2
(45) Date of Patent: Oct. 23, 2018

(54) CIGARETTE SMOKING DEVICE HAVING ELECTRONIC ATOMIZATION FUNCTION AND METHOD FOR IMPROVING CIGARETTE SMOKING QUALITY

(71) Applicant: CHINA TOBACCO YUNNAN INDUSTRIAL CO., LTD, Kunming (CN)

(72) Inventors: Yi Han, Kunming (CN); Shoubo Li, Kunming (CN); Donglai Zhu, Kunming (CN); Xiaowei Gong, Kunming (CN); Xia Zhang, Kunming (CN); Yongkuan Chen, Kunming (CN); Xudong Zheng, Kunming (CN); Zhiyong Sun, Kunming (CN); Yongfeng Tian, Kunming (CN); Mingming Miao, Kunming (CN)

(73) Assignee: CHINA TOBACCO YUNNAN INDUSTRIAL CO., LTD, Kunming (CN)

( * ) Notice: Subject to any disclaimer, the term of this patent is extended or adjusted under 35 U.S.C. 154(b) by 0 days.

(21) Appl. No.: 15/555,516

(22) PCT Filed: Apr. 13, 2015

(86) PCT No.: PCT/CN2015/076391

§ 371 (c)(1),
(2) Date: Sep. 4, 2017

(87) PCT Pub. No.: WO2016/138689

PCT Pub. Date: Sep. 9, 2016

(65) Prior Publication Data

US 2018/0042299 A1 Feb. 15, 2018

(30) Foreign Application Priority Data

Mar. 3, 2015 (CN) ..... 2015 1 0093568
Mar. 3, 2015 (CN) ..... 2015 1 0093643

(51) Int. Cl.
*A24F 47/00* (2006.01)
*A24F 13/12* (2006.01)
(Continued)

(52) U.S. Cl.
CPC ..... *A24F 13/12* (2013.01); *A24F 13/06* (2013.01); *A24F 47/008* (2013.01); *H05B 3/46* (2013.01)

(58) Field of Classification Search
CPC ..... A24F 4/008; A24F 47/008
(Continued)

(56) References Cited

U.S. PATENT DOCUMENTS 4,254,782 A 3/1981 Ligeti
2007/0256697 A1* 11/2007 Yang ..... A24F 47/008 131/328
(Continued)

FOREIGN PATENT DOCUMENTS

CN 1333657 A 1/2002
CN 2912281 Y 6/2007
(Continued)

*Primary Examiner* — Phuong Dinh
(74) *Attorney, Agent, or Firm* — Gokalp Bayramoglu

(57) ABSTRACT

The present invention relates to a cigarette smoking device having an electronic atomization function, including a cigarette holder and an electronic atomization component cooperatively assembled with one another, wherein the cigarette holder includes a cigarette holding cavity and an optional end cap for closing the open end of a shell; the electronic atomization component includes the shell and the following components located in the shell: a power supply, an airflow sensor switch and an atomizer provided with a central airflow channel; the cigarette holding cavity is in air communication with the central airflow channel of the atomizer; the cigarette smoking device further includes an airflow sensor switch air inlet penetrating the shell and/or the end cap of the cigarette holder. Also provided is a method for
(Continued)

improving cigarette smoking quality, the method includes smoking after mainstream smoke generated by an end-lighting cigarette, dilution air and atomization vapor are mixed.

15 Claims, 6 Drawing Sheets

(51) Int. Cl.
*A24F 13/06* (2006.01)
*H05B 3/46* (2006.01)

(58) Field of Classification Search
USPC ..... 131/328, 329
See application file for complete search history.

(56) References Cited

U.S. PATENT DOCUMENTS

2010/0065075 A1* 3/2010 Banerjee ..... A24B 15/165 131/328
2013/0255702 A1* 10/2013 Griffith, Jr. ..... A24F 47/008 131/328

FOREIGN PATENT DOCUMENTS

| | | | |
|---|---|---|---|
| CN | 201557554 | U | 8/2010 |
| CN | 202085723 | U | 12/2011 |
| CN | 102697185 | A | 10/2012 |
| CN | 103271447 | A | 9/2013 |
| CN | 103519348 | A | 1/2014 |
| CN | 203369386 | U | 1/2014 |
| CN | 204483007 | U | 7/2015 |

* cited by examiner

CIGARETTE SMOKING DEVICE HAVING ELECTRONIC ATOMIZATION FUNCTION AND METHOD FOR IMPROVING CIGARETTE SMOKING QUALITY

CROSS REFERENCE TO RELATED APPLICATIONS

This application is the national phase entry of International Application No. PCT/CN2015/076391, filed on Apr. 13, 2015, which is based upon and claims priority to Chinese Patent Applications No. CN2015100935687 and No. CN201510093643X, both filed on Mar. 3, 2015, the entire contents of which are incorporated herein by reference.

TECHNICAL FIELD OF THE INVENTION

The present invention relates to the field of a traditional cigarette technique, and more particularly to a cigarette smoking device having an electronic atomization function. The present invention also relates to a method for improving cigarette smoking quality.

BACKGROUND OF THE INVENTION

In order to reduce the damage of smoking to a smoker and public health, a cigarette harm reduction technique has become a main means to reduce the inhalation of a harmful substance in a cigarette smoke. The cigarette harm reduction technique in the prior art mainly includes the change in the combustion state of a cigarette and the adoption in a special filter tip to reduce the harmful components of a mainstream smoke. The former uses a high permeability cigarette paper or blends a tobacco flake, an expanded tobacco shred and a stem in a tobacco shred, wherein the high permeability cigarette paper may dilute the smoke of a cigarette part and improve a burning speed; blending the tobacco flake, the expanded shred and the stem may increase the filling of the tobacco shred and speed up the burning speed of the cigarette, but reduce the number of the smoking at the same time, this will result in an increase in the absolute amount of smoked cigarettes. The latter uses a filter tip trapping technique and a filter tip ventilation dilution technique, the filter tip trapping technique is to add an activated carbon, a zeolite and other adsorbents in the filter tip or make binary or multiple composite filter tips and the special-shaped filter tips in different structures, this may selectively trap the harmful components in the mainstream smoke, but have the problems such as some aroma components trapped by a filter material, affecting the taste of the cigarette, a complex production process and so on; the filter tip ventilation dilution technique is to perforate a tipping paper, use a high permeability forming paper or make a groove in a filter rod, etc., so that air is introduced into the filter tip to dilute the mainstream smoke when smoking the cigarette, so as to achieve the purpose of harm reduction, however, due to the dilution of the smoke, it is needed to maintain the taste of the cigarette by adding an essence and a flavor and using compensation measures.

The comfort of the cigarette has a greater relationship with the moisture of the smoke, the study found that the suitability of the smoke moisture would make the smoke be soft and delicate, small irritation, and better sensory comfort; when the smoke moisture content is low, this will lead to dry smoke, bigger irritation and reduced sensory comfort. The nicotine in the cigarette smoke comprises the nicotine under a combination state and the nicotine under a free state, the smoke irritation is mainly determined by the content of the nicotine under the free state. The relative content of the two states of the nicotine is related to the environment (for example, humidity, and PH) of the smoke. The nicotine under the free state may be combined with hydrogen ions in the smoke to form a salt (the nicotine under the combination state), when the moisture content (humidity) of the smoke is low, the hydrogen ion concentration decreases, this will inhibit the formation of the nicotine under the combination state while also decreasing the water solubility of the nicotine under the combination state, this makes it easier to decompose the nicotine under the combination state into the nicotine under the free state, so that the relative content of the nicotine under the free state increases, and the nicotine under the free state/the total nicotine also increases, resulting in the increase in the irritation and dryness. However, if the humidity of the smoke is too large, the nicotine under the free state will be too low, which will fail to reach the physiological strength required by the smoker. Therefore, the change of the moisture content (humidity) of the smoke will significantly affect the state distribution of the nicotine, so that the nicotine under the free state and the ratio of the nicotine under the free state/the nicotine will change significantly. Under low humidity conditions, the content of the nicotine under the free state and the ratio of the nicotine under the free state to the nicotine both increase, so that the cigarette product is easier to produce irritation when being smoked in an dry environment than being smoked in an wet environment. In order to make the product have the higher ratio of the nicotine under the free state to the nicotine, and ensure the stability of the nicotine under different wet environments to solve the problem of the bigger irritation of the product in the dry environment, a glycerol may be added into the tobacco shred to increase the moisture of the cigarette smoke and improve the sensor comfort of the cigarette. However, the study has shown that the glycerol and other humectants in the cigarette shred may have thermal cracking under the burning temperature (900° C.) of the cigarette to produce harmful aldehydes (especially acrolein).

When the cigarette with a middle or low tar is smoked, although the tar content is lowered, this also has lowered physiological satisfaction, decreased aroma amount, worse comfort and other problems at the same time. Currently, the problems of dilution and faint smokes due to the lowered tar amount of the cigarette are solved by means of adding the essence and the flavor, to improve the odor of the cigarette, enrich the aroma amount and maintain a good sensory quality. A compensation method in the prior art for adding the essence and the flavor is to add a cotton thread impregnated with liquid flavor essence or to add a flavor microcapsule to the filter tip during the course of the acetate fiber molding of the filter tip so that fragrance is released during the smoking to improve the smoking taste of the cigarette. In the process of the smoking, as the essence and the flavor are increasingly reduced due to the continuous release, the mixture of each smoke and the essence components is inconsistent, so that the smoking taste of each puff is quite different. In addition, the microcapsule containing the flavor may release the aroma components only when being broken, which brings inconvenience to the smoking.

SUMMARY OF THE INVENTION

In view of the above deficiencies of the prior art, the present invention provides a cigarette smoking device having an electronic atomization function, The present invention aims at increasing the smoking number of the cigarette by mixing the mainstream smoke of the cigarette and atomization vapor, improving the smoking sensory quality, reducing the harm of the smoking to the human body and the surrounding environment, and changing the compensation technique in the prior art of the essence and the flavor to increase the consistency of smoking taste of each puff and expand the use function of the cigarette. The object of the invention is obtained through the following technical solution:

The first aspect of the present invention relates to a cigarette smoking device having an electronic atomization function, comprising a cigarette holder 1 and an electronic atomization component which are cooperatively assembled one another; wherein the cigarette holder 1 comprises a cigarette holding cavity and an optional end cap; the electronic atomization component comprises a shell 7 and the following components located in the shell 7: a power supply 5, an airflow sensor switch 3 and an atomizer 8 provided with a central airflow channel; the optional end cap is used for closing one open end of the shell 7 when in existence; the cigarette holding cavity is in air communication with the central airflow channel of the atomizer 8; the cigarette smoking device also comprises an airflow sensor switch air inlet 2 penetrating the shell 7 and/or the optional end cap of the cigarette holder, the airflow sensor switch air inlet 2 is in air communication with the central airflow channel of the atomizer 8 through the airflow sensor switch 3.

The airflow sensor switch air inlet 2 penetrating the shell 7 or the end cap of the cigarette holder is required to ensure that intake airflow may quickly trigger the airflow sensor switch 3; when in use, a cigarette is inserted into the cigarette holding cavity in the cigarette holder, when the cigarette being lighted and smoked, the mainstream smoke generated by the lighted cigarette is smoked into the central airflow channel of the atomizer. Meanwhile, as a negative pressure is formed inside the electronic atomization component due to the smoking actions of the smoker, the ambient air enters into the inner part of the electronic atomization component through the airflow sensor switch air inlet 2 and triggers the airflow sensor switch 3, then, the ambient air enters into the central airflow channel of the atomizer to be mixed with the mainstream smoke, or is mixed with the mainstream smoke before entering into the central airflow channel of the atomizer, the role of the ambient air is to dilute the mainstream smoke as a dilution air and to cool the mainstream smoke. Meanwhile, as the airflow sensor switch 3 triggers the power supply 5 and the atomizer 8 is conducted through a connection terminal, the substance in the atomizer is heated to generate the atomization vapor, the formed atomization vapor also enters into the central airflow channel of the atomizer to be smoked by the smoker after being mixed with the mainstream smoke and the dilution air. The mainstream smoke refers to the smoke smoked from a smoking end of the cigarette when the cigarette is smoked, i.e., the portion capable of being smoked from the generated smoke.

The connection terminal is connected with the power supply 5 and the atomizer 8 or connected with the power supply 5 or an external charging device. The power supply 5 is a disposable battery or a rechargeable battery. Preferably, the rechargeable battery is a polymer lithium battery. The atomizer may be the atomizer in the prior art, the operating temperature of the atomizer is 150° C. to 350° C.

In a preferred embodiment, the shell 7 is divided into two cavities, the first cavity receives the atomizer 8 while the second cavity receives the power supply 5 and the airflow sensor switch 3. The two cavities may be relatively self-enclosed, but may have a necessary air inlet. Or, the two cavities may have an open end and is relatively closed by the cooperation between the cigarette holding cavity of the cigarette holder and the end cap.

In a preferred embodiment, the atomizer 8 comprises an electric heating wire, a liquid storing cavity for storing an liquid to be atomized, and a liquid guiding device for guiding the liquid to be atomized to the electric heating wire. In a preferred embodiment, the electric heating wire evaporates an liquid to be atomized in a temperature range of 150° C. to 350° C. to obtain the atomization vapor.

In a preferred embodiment, the electric heating wire is located in the central airflow channel; independently, the liquid guiding device is a liquid guiding rope or a liquid guiding pipe.

Preferably, the liquid to be atomized contains one or more of a flavoring substance, a drug extract or a glycerol. The liquid to be atomized is a liquid containing a volatile substance and capable of being atomized upon heating. The liquid to be atomized evaporates and atomizes to form an aerosol, which is smoked by the smoker after being mixed with the mainstream smoke of the cigarette and the dilution air. When the mainstream smoke of the cigarette passes through the wet environment containing the volatile material, the volatile material facilitates the migration of the nicotine to the smoke and releases the free (aprotic) nicotine produced by the vaporization of the smoke particles, making the free nicotine migrate in the form of vapor, being conducive to increasing the amount of the free nicotine in the smoke, thereby enhancing the physical sensory strength of the smoker. The different compositions of the liquid to be atomized may also play different roles in the mainstream smoke of the cigarette, including the action of reducing the damage of the mainstream smoke of the cigarette, the action of improving the smoking sensory quality of the cigarette, and the action of supplementing the aroma composition of the mainstream smoke of the cigarette or an auxiliary pharmacological action. Preferably, the liquid to be atomized is the glycerol having hygroscopicity or a mixed liquid taking the glycerol as a main component and containing the volatile substance. Due to the hygroscopicity thereof, the glycerol may increase the moisture content of the mainstream smoke, thereby reducing the irritation of the mainstream smoke, improving the delicate softness of the smoke, and significantly improving the sensitivity of the cigarette.

Preferably, the volatile substance may be the flavoring substance or other functional components, the flavoring substance may be the essence and the flavor, which, after evaporation, are mixed with the mainstream smoke of the cigarette, this serves to supplement the aroma while ensuring the consistency of the taste of each smoking; the other functional components include some pharmacologically active drug extracts which, after evaporation, are mixed with the mainstream smoke of the cigarettes, this functions as a certain therapeutic effect while satisfying the physiological feelings of the smoking.

In a preferred embodiment, the cigarette smoking device having the electronic atomization function further comprises a light transmission hole 6 of a status indicator lamp located on the shell 7 and a status indicator lamp (not shown) located in the shell 7. Preferably, the cigarette smoking device further comprises a light guide base 9 located on the light transmission hole 6 of the status indicator lamp, the light guide base 9 is actually one closing cap of the light transmission hole 6 of the indicator lamp, the light of the status indicator light is emitted through the light transmission hole 6 of the status indicator lamp and the light guide base 9. The light guide base 9 may prevent dust from falling into the inside of the shell 7 through the light transmission hole 6 of the status indicator lamp. When the power supply is operated, the light of the status indicator lamp connected to the power supply 5 may transmits out from the light guide base 9 and the light transmission hole 6 of the status indicator lamp 6 to indicate the operating state of the cigarette smoking device.

The cigarette holder 1 may be any holder capable of being connected to the electronic atomization component of the present invention and capable of holding the cigarette in the prior art. The cigarette holder 1 and the electronic atomization component are fixedly connected or detachably connected. The cigarette holder may optionally have an end cap that may be used for enclosing an open end of the shell 7 of the electronic atomization component. At this time, this is equivalent to the end cap and the shell 7 together to form a relatively enclosed space. The cigarette holder may also have no end cap, in which case the shell 7 is required to be relatively self-enclosed and does not have the open end, but the necessary air inlet is provided on the end surface or side surface thereof. Preferably, the cigarette holding cavity in the cigarette holder 1 may meet the need for airtight bonding of the cigarette with different circumferences or a cigarette filter tip by providing different cigarette holding devices therein. In a preferred embodiment, the cigarette holding cavity of the cigarette holder 1 is provided therein with a variable-diameter holding device to hold the cigarettes with variable diameters, the variable-diameter holding device is selected from a plurality of overlapping washers which are successively reduced in diameter from an opening of the cigarette holding cavity, or a spring clamping head, or a multiple-jaw chuck holder. For a method in the prior art for regulating the holding diameter of the cigarette holder, the holder is provided therein with the washers with different inner diameters, the washers are overlapped in turn from the large to the small, to hold the cigarettes with different diameters, as shown in FIG. 5. For another method in the prior art for regulating the holding diameter of the holder, the spring clamping head is used, as shown in FIG. 6, the spring clamping head is a plurality of spring clamping pieces 202 which are arranged in a sleeve 201 provided with a threaded joint, are provided in a conical arrangement and are co-end, after being inserted with a holding object 203, the spring clamping piece is extruded and deformed, the holding diameter thereof is regulated by means of the elasticity of the spring clamping piece itself. Another industry-common holder with an adjustable holding diameter is the multiple-jaw chuck holder, among them, the most common one is a three-jaw chuck holder, shown in FIG. 7 and is the prior art, The specific structure and operating principle thereof may be summarized as follows: the three-jaw chuck holder has a holder mounting screw 102 which is provided thereon with a thread for mounting on other apparatuses. the mounting screw 102 is provided thereon with a holding block support 103 and a holding block Adjusting Disk which are coaxially arranged therewith and have flange structures, one side of the holding block Adjusting Disk 104 is provided with a bevel gear, and the other side thereof is provided with teeth which are a plane thread (a vortex line) shape (for example, a coiled mosquito-like shape) along an axis center, three movable holding blocks 105 are meshed with the teeth through a tooth space itself, the three movable holding blocks 105 are used for holding a held object 107. One Adjusting Gear 101 is located at the edge of the holding block Adjusting Disk and meshed with the bevel gear on the holding block Adjusting Disk 104 through the bevel gear itself. The three movable holding blocks 105 are each limited by two movable block stoppers fixed on the holding block support 103 so that the movable holding block 105 may only move radially without rotation, In FIG. 7, only two sets of the movable block stoppers are shown in order to simplify the drawing. When a user manually rotates the Adjusting Gear 101, the Adjusting Gear 101 rotates the holding block Adjusting Disk 104 through the meshing action of the bevel tooth, and further rotates the teeth thereon which are the plane thread (the vortex line) shape, by means of the meshing relationship between the tooth spaces between these teeth and the movable holding block 105, the rotation movement of the teeth along the axis center is converted into the radial movement of the movable block close to or away from the axis center, so as to realize the continuous adjustment of a holding diameter. More details on the multiple-jaw chuck holder may be found in relevant technical data in the prior art and are not repeated in this paper again. In addition, the present inventor also invents another novel drawbar cigarette holder, which may also continuously adjust the holding diameter and will be applied in another case along with the relevant content of the drawbar holder.

In a preferred embodiment, the airflow sensor switch air inlet 2 is located on the side surface or the end surface of the portion of the shell surrounding the second cavity.

In a preferred embodiment, the airflow sensor switch 3 and the atomizer 8 are both electrically connected to the power supply 5, an electric connection way therebetween enables the airflow sensor switch 3 to control whether the atomizer 8 is electrified or not. Preferably, a silicone sleeve 4 is provided on the periphery of the airflow sensor switch 3. The silicone sleeve 4 is used for airtightly fixing the airflow sensor switch 3 so that the airflow entering from the airflow sensor switch air inlet 2 completely passes through the airflow sensor switch 3 to effectively trigger the airflow sensor switch 3. The airflow sensor switch 3 and the silicone sleeve 4 together constitute an airflow sensor.

In a preferred embodiment, the downstream of the center airflow channel of the atomizer 8 is connected to a mouthpiece.

In a preferred embodiment, the cigarette is an end-lighting cigarette. Preferably, a cigarette with the filter tip is smoked with the cigarette smoking device having the electronic atomization function of the present invention, the filter tip may trap one portion of tar to prevent the tar generated by the combustion of the cigarette from clogging the airflow channel.

Preferably, the shell 7 also comprises the connection terminal therein, the connection terminal comprises a positive electrode 12 and a negative wire connection base 10; the positive electrode 12 is connected to the power supply 5; the negative wire connection base 10 is connected to the atomizer 8 or to an external charging device. When the cigarette is smoked, the connection terminal serves to connect the atomizer and the power supply, the positive electrode 12 of the connection terminal is connected to the power supply 5, the negative wire connection base 10 is connected to the atomizer 8; when the power supply 5 is a chargeable power supply and needs to be charged, the connection terminal functions as the external charging device and the power supply, the positive electrode 12 of the connection terminal is connected to the power supply 5, the negative wire connection base 10 is connected to the external charging device, the power supply 5 is charged.

In a preferred embodiment, the connection terminal also comprises an insulating sleeve 11 located between the positive electrode 12 and the negative wire connection base 10. The insulating sleeve 11 is used for blocking the negative wire connection base 10 and the positive electrode 12.

A second aspect of the present invention relates to a method for improving cigarette smoking quality, comprising smoking is performed after mainstream smoke generated by an end-lighting cigarette, dilution air and atomization vapor are mixed. The mainstream smoke refers to the smoke smoked from the smoking end of the cigarette when smoking, i.e., the portion of the smoke that is generated from the smoke and may be smoked.

In a preferred embodiment, the atomization vapor contains one or more of the flavoring substance, a traditional Chinese medicine extract or a humectant. Preferably, the humectant is the glycerol.

In a preferred embodiment, the mainstream smoke is mixed with the dilution air and the atomization vapor after leaving the end-lighting cigarette.

In a preferred embodiment, the method for improving the cigarette smoking quality of the present invention is achieved by using a cigarette smoking device having an electron atomizing function according to a first aspect of the present invention to smoke the end-lighting cigarette.

The present invention has the following beneficial effects:

Compared with the cigarette smoking way in the prior art, the cigarette smoking g device having the electronic atomization function of the present invention has the following advantages:

1. Compared to the cigarette smoking way in the prior art, the cigarette is smoked through the cigarette smoking device having the electronic atomization function according to the present invention, this dilutes the mainstream smoke of the cigarette and reduces main harmful components while further reducing piquant and spicy feeling and improving smoking sensory quality, this is because the glycerol and other substances in the atomizer may increase the moisture content of the mainstream smoke due to the hygroscopicity, thereby reducing the irritation of the mainstream smoke, improving the delicate softness of the smoke and significantly improving the sensory comfort of the cigarette. Meanwhile, the method of the present invention also improves the flavoring and perfuming techniques and the moisture retention way of the cigarette in the prior art.

2. When the mainstream smoke of the cigarette passes through the airflow channel containing the atomization vapor in the atomizer, the atomization vapor and the wet environment facilitate the migration of the nicotine to the smoke and releases the free (aprotic) nicotine produced by the vaporization of the smoke particles, making the free nicotine migrate in the form of vapor, being conducive to increasing the amount of the free nicotine in the smoke, thereby enhancing the physical sensory strength of the smoker.

3. In the cigarette smoking device of the present invention, the glycerol is evaporated at low temperature, reducing the content of aldehydes (especially acrolein) produced by the pyrolysis of the glycerol; the glycerol-containing smoke particles increase the particle size due to the easier absorption of water steam, so that the remained smoke particle-phase matter increases, therefore, more smoke particles remain in the mouth, reducing the particle-phase matter in the mainstream smoke remained in the lungs, and reducing the damage of the smoking to the lungs.

4. Through the atomization of the liquid to be atomized with different functions, different smoking feelings can be brought for the cigarette, compared to the way that function components are added to the filter tip in the prior art, the smoking device is used more conveniently; furthermore, the ways including the way of adding the drug extract to the liquid to be atomized also may function as a therapeutic purpose, not only reducing the damage of the smoking but also being capable of functioning as the therapeutic purpose.

5. As the filter tip of the cigarette is airtightly inserted into the cigarette holder, the inhaled air is mainly from the diluted air entering from the shell or end cap of the cigarette holder of the electronic atomization component, correspondingly reducing the air amount entering the cigarette from the end of the cigarette, slowing down the burning speed of the cigarette, reducing the intake amount of the harmful substances of each smoking and adding the number of the smoking.

Compared to an electronic cigarette containing nicotine in the smoke oil in the prior art, the cigarette smoking device having the electronic atomization function has the following advantages:

1. For the electronic cigarette containing the nicotine in the smoke oil in the prior art, the smoke oil containing the glycerol as the main component contains a certain concentration of the nicotine, when the smoke oil is atomized, the nicotine is delivered together with the atomized smoke oil, however, for the cigarette smoking device of the present invention, the traditional cigarette firstly burns and releases the nicotine, the nicotine is mixed with the atomization vapor in the atomizer and delivered. In comparison with the two cases, the nicotine delivered by the cigarette smoking device of the present invention originates from the tobacco leaf itself, is endogenous and is released by the combustion of the cigarette; however, the nicotine delivered by the electronic cigarette in the prior art is manually added into the smoke oil, is exogenous and is released through the evaporation of the smoke oil. The nicotine used by the latter is mainly from a tobacco extract, having a complex extraction process and higher cost, furthermore, the heating temperature of the electronic cigarette in the prior art is lower than the burning temperature of the cigarette, and the release amount of the nicotine is not enough, however, the device of the present invention may ensure the release amount of the nicotine while reducing the damage of other harmful substances to the health.

2. When the electronic cigarette in the prior art is smoked, the delivery efficiency of the nicotine of the electronic cigarette in the prior art is lower than that of the traditional cigarette. The nicotine delivered by the cigarette smoking device of the present invention is actually from the traditional cigarette, and therefore, the nicotine delivery efficiency is higher than that of the electronic cigarette in the prior art.

3. The smoke oil of the electronic cigarette containing the nicotine in the prior art is often added with the flavoring substances, such as mint, vanilla, fruit flavor substances and so on. When the nicotine is dissolved in the smoke oil containing these flavoring substances, the nicotine is easily oxidized by these flavoring substances, affecting the stability of a product. However, for the cigarette smoking device of the present invention, the nicotine and the favoring substances in the liquid to be atomized may be mixed as the form of the aerosol only when being smoked, due to the short mixing time and the low content of each smoking, there is no the problem of nicotine deterioration in the nicotine-containing electronic cigarette in the prior art.

4. Compared to the nicotine-containing electronic cigarette in the prior art, the cigarette smoking device in the present invention significantly increases the content of the nicotine in the inhaled smoke in the same volume, having better physiological satisfaction of the nicotine and significantly reducing the smoking sweet feeling of the electronic cigarette in the prior art (glycerol and propylene glycol as the main components of a smoke oil solvent).

REFERENCE SIGNS

1—Cigarette Holder; 2—Airflow Sensor Switch Air Inlet; 3—Airflow Sensor Switch; 4—Silicone Sleeve; 5—Power Supply; 6—Light Transmission Hole of Status Indicator Lamp; 7—Shell; 8—Atomizer; 9—Light Guide Base; 10—Negative Wire Connection Base; 11—Insulating Sleeve; 12—Positive Electrode; 13—Cigarette; 14—Side Cap of Shell

401—Threaded Riveted Joint; 402—Negative Wire; 403—Positive Wire; 404—Glass Fiber Oil-Guide Rope; 405—Heating Wire; 406—Oil Storage Cotton; 407—Fiber Sleeve; 408—Top End Cap; 409—Housing; 410—Airflow Channel; 411—Air Inlet;

201—Sleeve; 202—Spring Clamping Piece; 203—Held Object;

101—Adjusting Gear; 102—Mounting Screw; 103—Holding Block Support; 104—Holding Block Adjusting Disk; 105—Movable Holding Block; 106—Movable Block Limit; 107—Held Object.

DETAILED DESCRIPTION OF THE INVENTION

The present invention is described in further details in combination with embodiments and the accompanying drawings, which are not to be construed as limiting the present invention.

Embodiment 1

Figure 1:
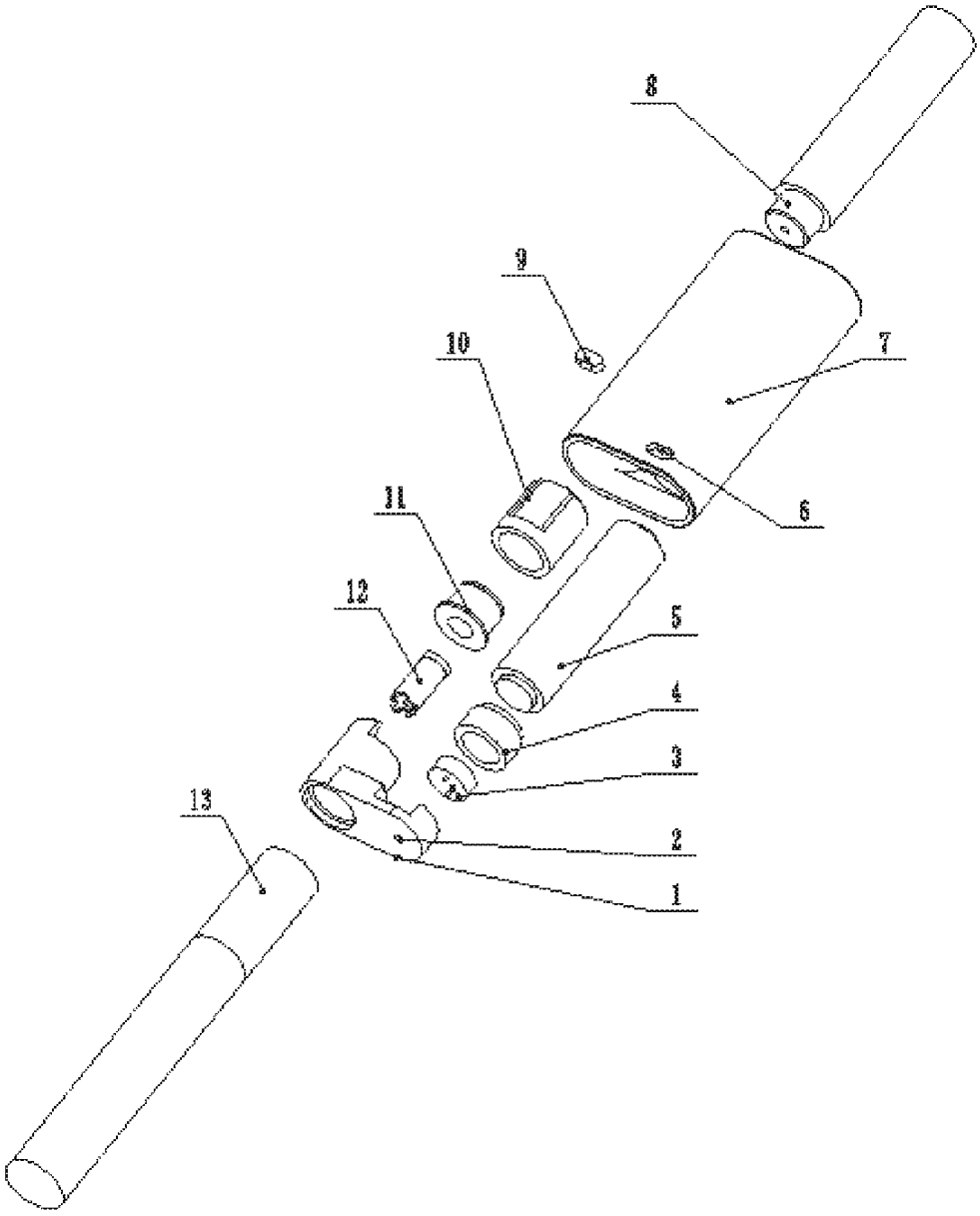
FIG. 1 is exploded views of various components of the cigarette smoking device having an electronic atomization function according to the present invention.
Figure 2:
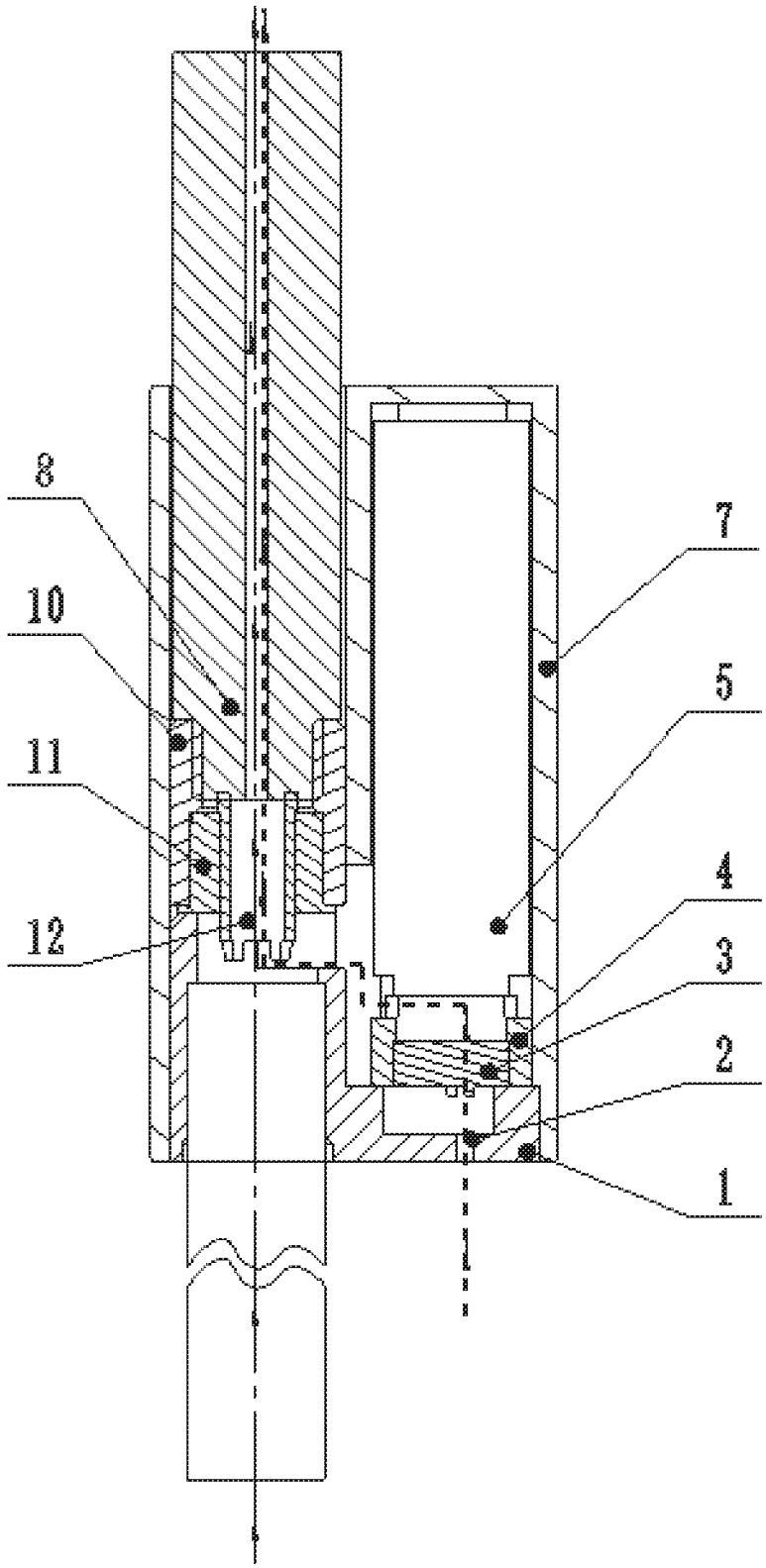
FIG. 2 is an internal cross-sectional view of a cigarette smoking device according to Embodiment 1 of the present invention. An airflow sensor switch air inlet 2 is located on an end cap of a cigarette holder 1. A dotted line indicates the airflow of the mainstream smoke of a cigarette; a dashed line indicates the diluted airflow inhaled after an airflow sensor switch is triggered. The airflow of the mainstream smoke of the cigarette and the diluted airflow are inhaled after entering an atomizer and being mixed with an atomization vapor in the atomizer.

A cigarette smoking device having an electronic atomization function as shown in FIG. 2 comprises a cigarette holder 1 and an electronic atomization component which are connected with one another; wherein the cigarette holder 1 comprises a cigarette holding cavity and an end cap which are arranged in parallel; the electronic atomization component comprises a shell 7 and the following components located in the shell 7: a power supply 5 (a rechargeable polymer lithium battery), an airflow sensor switch 3, a connection terminal and an atomizer 8 provided with a central airflow channel; the cigarette holding cavity is in air communication with the central airflow channel of the atomizer 8; the cigarette smoking device also comprises an airflow sensor switch air inlet 2 penetrating the end cap of the cigarette holder, the airflow sensor switch air inlet 2 is in air communication with the central airflow channel of the atomizer 8 through the airflow sensor switch 3. The cigarette holder 1 and the electronic atomization component are fixedly connected.

The shell 7 is divided into two cavities, the first cavity receives the atomizer 8 and the connection terminal while the second cavity receives the power supply 5 and the airflow sensor switch 3. The connection terminal is connected with the power supply 5 and the atomizer 8 or connected with the power supply 5 and an external charging device.

The airflow sensor switch air inlet 2 penetrates the end cap of the cigarette holder. The direction of the intake airflow of the airflow sensor switch air inlet 2 is parallel to the insertion direction of a cigarette. The airflow sensor switch air inlet 2 penetrating the end cap of the cigarette holder may ensure that the airflow can quickly trigger the airflow sensor switch 3. When in use, the cigarette is inserted into the cigarette holding cavity in the cigarette holder, when the cigarette being lighted and smoked, the interior of the electronic atomization assembly forms a negative pressure so that ambient air enters the interior of the electronic atomization component from the airflow sensor switch air inlet 2, triggers the airflow sensor switch 3 and causes the power supply 5 and the atomizer 8 to be conducted via the connection terminal, a substance in the atomizer is heated to produce an atomization vapor, the formed atomization vapor, the mainstream smoke of the cigarette entering into the shell from a filter tip end of the cigarette and the inhaled ambient air are finally mixed in the atomizer and then smoked into the mouth of a smoker.

Figure 4:
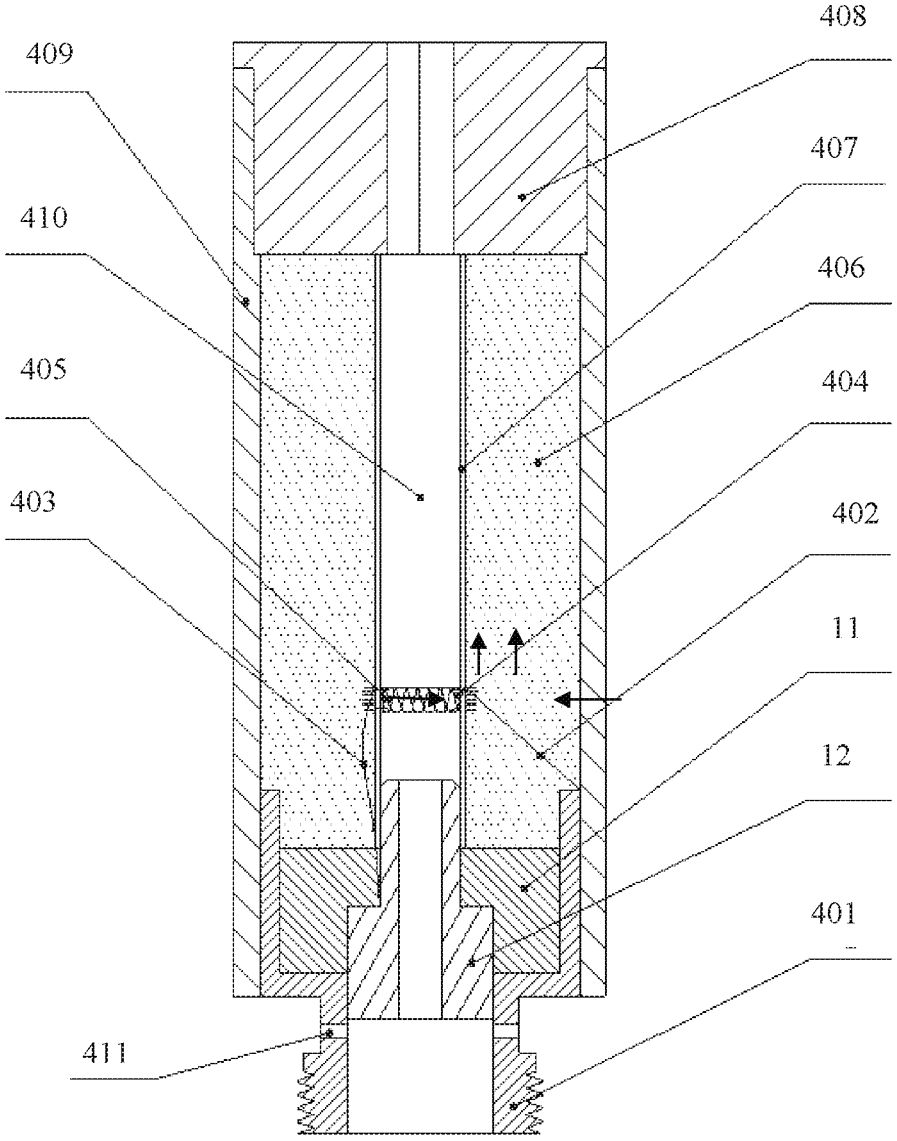
FIG. 4 is a structural view of an atomizer 8 used in Embodiment 1 of the present invention. The direction of an arrow indicates the direction of the delivery of the liquid to be atomized and the atomization vapor. The liquid to be atomized is guided from an oil storage cotton 406 to a heating wire 405 through a glass fiber oil-guide rope 404, is heated and atomized on the heating wire, forms a vapor in an airflow channel, and then is mixed with the mainstream smoke of a cigarette entered from the bottom of the airflow channel and the inhaled diluted airflow after an airflow sensor switch is triggered.
Figure 5:
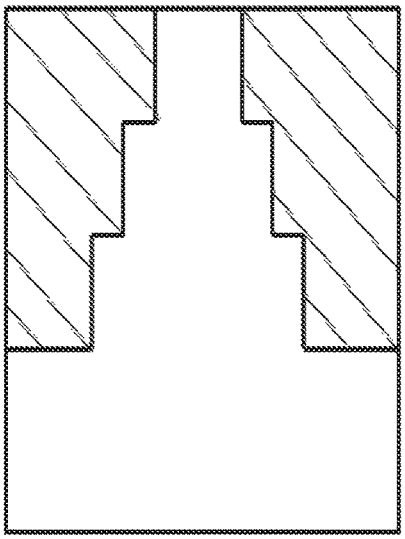
FIG. 5 is a structural view of a cigarette holder in the prior art that changes a diameter via a plurality of overlapped washers.
Figure 6:
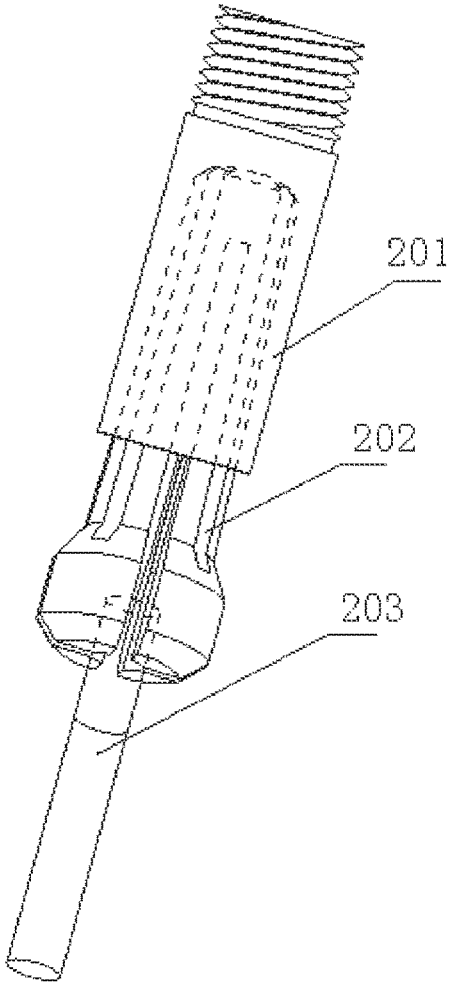
FIG. 6 is a view of a cigarette holder in the prior art that holds a cigarette with a spring clamping head.
Figure 7:
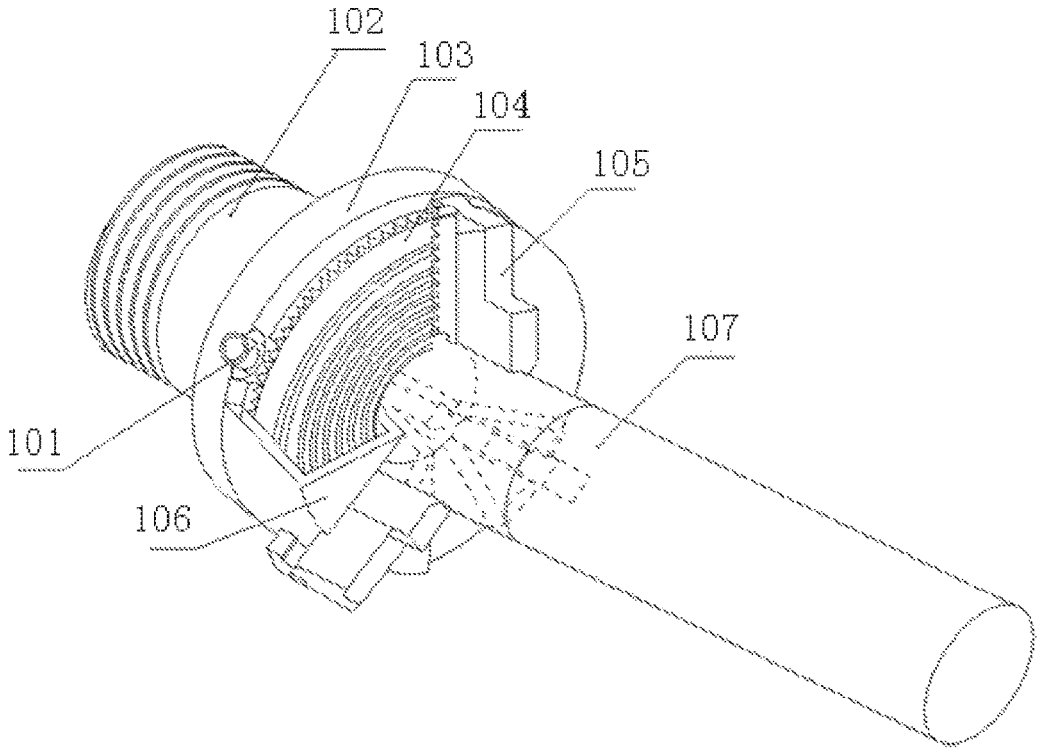
FIG. 7 is a view of a multiple-jaw chuck type variable diameter cigarette holder in the prior art for holding a cigarette.

The specific structure of the atomizer 8 shown in FIG. 4 is a disposable atomizer and comprises an electric heating wire connected with the connection terminal, a liquid storing cavity for storing an liquid to be atomized, and a liquid guiding device for guiding the liquid to be atomized to the electric heating wire. The electric heating wire of the atomizer 8 is located in the central airflow channel; the liquid guiding device is a liquid guiding rope; the downstream of the center airflow channel of the atomizer 8 is connected to a mouthpiece.

The cigarette smoking device having the electronic atomization function of Embodiment 1 further comprises a light transmission hole 6 of a status indicator lamp located on the shell 7 and a status indicator lamp (not shown) located in the shell 7. The cigarette smoking device further comprises a light guide base 9 located on the light transmission hole 6 of the status indicator lamp. When the power supply is operated, the light of the status indicator lamp connected to the power supply 5 may be transmitted out from the light guide base 9 to indicate the operating state of the cigarette smoking device.

The airflow sensor switch 3 and the atomizer 8 are both electrically connected to the power supply 5, an electric connection way therebetween enables the airflow sensor switch 3 to control whether the atomizer 8 is electrified or not. A silicone sleeve 4 is provided on the periphery of the airflow sensor switch 3. The silicone sleeve 4 is used for airtightly fixing the airflow sensor switch 3 so that the airflow entering from the airflow sensor switch air inlet 2 completely passes through the airflow sensor switch 3 to effectively trigger the airflow sensor switch 3. The airflow sensor switch 3 and the silicone sleeve 4 together constitute an airflow sensor.

The shell 7 also comprises the connection terminal therein, the connection terminal comprises a positive electrode 12 and a negative wire connection base 10; the positive electrode 12 is connected to the power supply 5; the negative wire connection base 10 is connected to the atomizer 8. The connection terminal also comprises an insulating sleeve 11 located between the positive electrode 12 and the negative wire connection base 10. The insulating sleeve 11 is used for blocking the negative wire connection base 10 and the positive electrode 12. When the cigarette is smoked, the connection terminal serves to connect the atomizer and the power supply, the positive electrode 12 of the connection terminal is connected to the power supply 5, the negative wire connection base 10 is connected to the atomizer 8; when the power supply 5 needs to be charged, the connection terminal functions as the external charging device and the power supply, the positive electrode 12 of the connection terminal is connected to the power supply 5, the negative wire connection base 10 is connected to the external charging device, the power supply 5 is charged.

Embodiment 2

Figure 3:
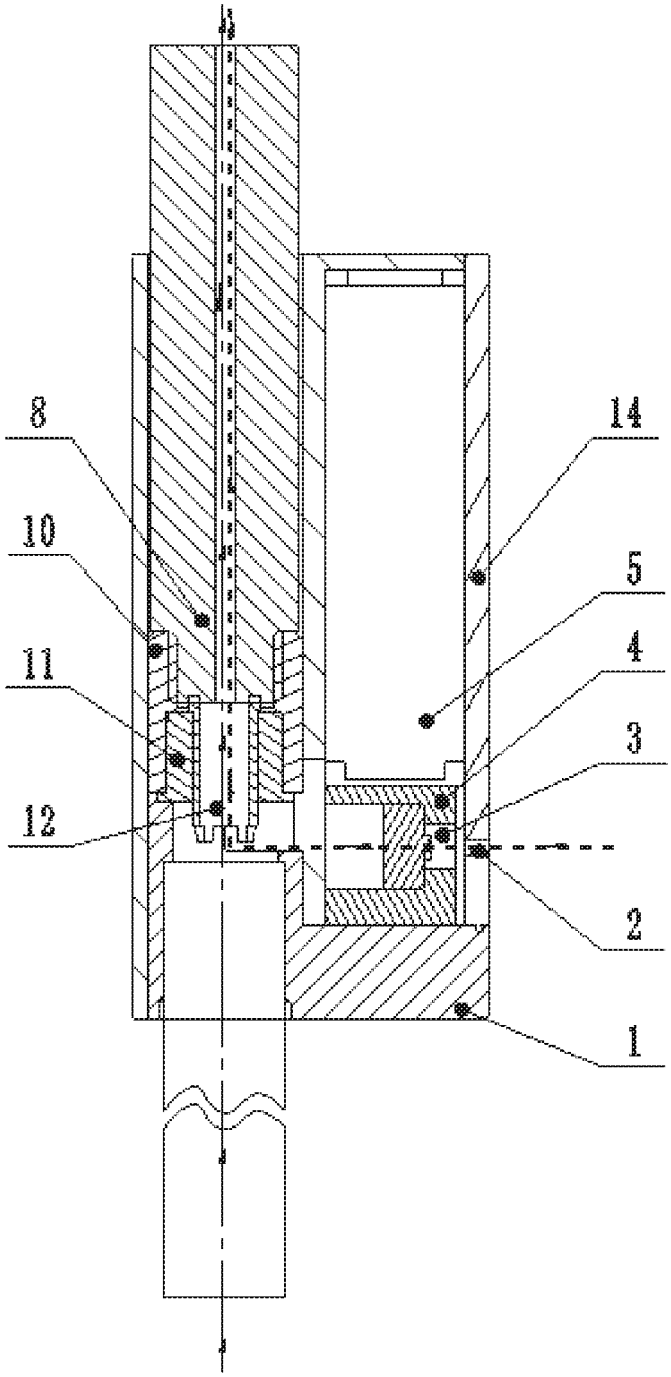
FIG. 3 is an internal cross-sectional view of a cigarette smoking device according to Embodiment 2 of the present invention. An airflow sensor switch air inlet 2 is located on a shell of an electronic atomization component. A dotted line indicates the airflow of the mainstream smoke of a cigarette; a dashed line indicates the diluted airflow inhaled after an airflow sensor switch is triggered. The airflow of the mainstream smoke of the cigarette and the diluted airflow are inhaled after entering an atomizer and being mixed with an atomization vapor in the atomizer.

As shown in FIG. 3, a cigarette smoking device having an electronic atomization function differs from the cigarette smoking device of Embodiment 1 in that a cigarette holder 1 and an electronic atomization component in the cigarette smoking device are detachably connected; an airflow sensor switch air inlet 2 penetrates a shell 7 of the electronic atomization component, The direction of the intake airflow of the airflow sensor switch air inlet 2 is vertical to the insertion direction of a cigarette; the atomizer 8 has a liquid storage cavity which may be filled with an liquid to be atomized and comprise an electric heating wire connected to the connection terminal; the liquid to be atomized comprises glycerol, a flavoring substance and a drug extract. The device according to Embodiment 2 also comprises an end cap 14 of the shell, which is openable to facilitate the installation of an internal component of the shell.

The evaluation of the performance of the cigarette smoking device and the comparison of the cigarette smoking in the prior art are shown in Table 1-Table 6.

TABLE 1

Comparison of the smoking number between the device of the present invention and the smoking ways in the prior art of the same cigarette

| Cigarette sample No. | Smoking ways in the prior art (smoking number/cigarette) | The present invention (smoking number/cigarette) |
|---|---|---|
| 1 | 8 | 16 |
| 2 | 8 | 15 |
| 3 | 7 | 14 |
| 4 | 7 | 13 |
| 5 | 6 | 12 |
| 6 | 7 | 12 |

TABLE 2

Comparison of the smoking sensory quality between the device of the present invention and the smoking ways in the prior art of the same cigarette.

| | Cigarette sample No. | | | | | |
|---|---|---|---|---|---|---|
| | 1 | | 3 | | 5 | |
| Index | 0~10 | | 0~10 | | 0~10 | |
| Smoking ways | The prior art | The present invention | The prior art | The present invention | The prior art | The present invention |
| Comfort characteristics | 0~10 | | 0~10 | | 0~10 | |
| Oral irritation/ tongue burning | 7 | 8 | 8 | 9 | 8 | 9 |
| Oral residue/ dry feeling | 6 | 7 | 7 | 8 | 7 | 8 |
| Convergence | 7 | 7 | 7 | 7 | 7 | 7 |
| Throat irritation | 6 | 8 | 7 | 8 | 7 | 8 |
| Throat dryness | 7 | 8 | 7 | 8 | 7 | 8 |
| Nasal irritation | 7 | 7 | 7 | 7 | 7 | 7 |

Pursuant Method: "YC/T 497-2014 Cigarette Chinese Type Cigarette Style Sensory Evaluation Method"

Evaluation scores: 10—no; 9—micro; 8—slightly; 7—existence; 6: a little strong; ≤5—strong

TABLE 3

Comparison of the tar amount per cigarettes between the device of the present invention and the smoking ways in the prior art of the same cigarette

| Cigarette sample No. | Smoking ways in the prior art (mg/cigarette) | The present invention (mg/cigarette) |
|---|---|---|
| 1 | 9.8 | 9.1 |
| 2 | 8.1 | 7.6 |
| 3 | 7.9 | 7.4 |
| 4 | 5.2 | 4.6 |
| 5 | 7.8 | 7.2 |
| 6 | 5.1 | 4.5 |

TABLE 4

Comparison of the amount of free nicotine, total nicotine and the ratio of free nicotine/total nicotine produced by smoking the same cigarette between the device of the present invention and those by the smoking in the prior art.

| | Nicotine (mg/cigarette) | | Free Nicotine (mg/cigarette) | | Ratio of Free nicotine/total nicotine | |
|---|---|---|---|---|---|---|
| Cigarette sample No. | The prior art | The present invention | The prior art | The present invention | The prior art | The present invention |
| 1 | 1.05 | 0.98 | 0.27 | 0.24 | 0.257 | 0.245 |
| 2 | 0.84 | 0.79 | 0.23 | 0.20 | 0.274 | 0.253 |
| 3 | 0.80 | 0.74 | 0.26 | 0.22 | 0.325 | 0.297 |
| 4 | 0.52 | 0.50 | 0.21 | 0.18 | 0.404 | 0.360 |
| 5 | 0.74 | 0.71 | 0.24 | 0.21 | 0.324 | 0.296 |
| 6 | 0.48 | 0.45 | 0.20 | 0.17 | 0.417 | 0.378 |

TABLE 5

Comparison of the acrolein content in the smoke produced by smoking the same cigarette by the method of improving the cigarette smoking quality of the present invention and that produced by the smoking method in the prior art.

| Cigarette sample No. | The prior art (μg/cigarette) | The present invention (μg/cigarette) |
|---|---|---|
| 1 | 25.6 | 11.4 |
| 2 | 18.9 | 7.6 |
| 3 | 15.7 | 5.2 |
| 4 | 8.6 | 2.4 |
| 5 | 14.1 | 6.9 |
| 6 | 7.7 | 1.3 |

TABLE 6

Comparison of the moisture content of the smoke produced by smoking the same cigarette by the method of improving the cigarette smoking quality of the present invention and that by the smoking method in the prior art (the liquid to be atomized is pure glycerol).

| Cigarette sample No. | The prior art (mg/cigarette) | The present invention (mg/cigarette) |
|---|---|---|
| 1 | 2.8 | 3.7 |
| 2 | 2.5 | 3.2 |
| 3 | 2.1 | 3.6 |
| 4 | 2.6 | 3.2 |
| 5 | 3.0 | 4.3 |
| 6 | 2.4 | 4.0 |

Note: The conditions of the cigarettes used in the above experiments are as follows:

Cigarette 1—length of 84 mm, circumference diameter of 7.7 mm, box marked smoke nicotine amount of 1.0 mg, tar amount of 10 mg;

Cigarette 2—length of 84 mm, circumference diameter of 7.7 mm, box marked smoke nicotine amount of 0.8 mg, tar amount of 8 mg;

Cigarette 3—length of 94 mm, circumference diameter of 7.2 mm, box marked smoke nicotine amount of 0.8 mg, tar amount of 8 mg;

Cigarette 4—length of 94 mm, circumference diameter of 7.2 mm, box marked smoke nicotine amount of 0.5 mg, tar amount of 6 mg;

Cigarette 5—length of 100 mm, circumference diameter of 5.4 mm, box marked smoke nicotine amount of 0.8 mg, tar amount of 8 mg;

Cigarette 6—length of 100 mm, circumference diameter of 5.4 mm, box marked smoke nicotine amount of 0.5 mg, tar amount of 6 mg;

Referring to Table 1, the smoking number of the same cigarette on the cigarette smoking device of the present invention is significantly increased.

Referring to Table 2, the sensory qualities (especially comfort feeling) of the same cigarette on the cigarette smoking device of the present invention are significantly improved.

Referring to Table 3, the tar content produced by the smoking the same cigarette on the cigarette smoking device of the present invention is decreased.

Referring to Table 4, the free nicotine, the total nicotine and the ratio of free nicotine/nicotine produced by smoking the same cigarette on the cigarette smoking device of the present invention are all reduced to a certain extent, at the same time, the decrease in free nicotine exceeds the decrease in total nicotine, which plays an important role in improving sensory qualities (especially comfort feeling).

Referring to Table 5, the acrolein content of the harmful component produced by smoking the same cigarette by the method of improving the cigarette smoking quality of the present invention is remarkably reduced.

Referring to Table 6, the moisture content produced by smoking the same cigarette by the method of improving the cigarette smoking quality of the present invention is increased, thereby increasing the delicate softness of the smoke.

The invention claimed is:

1. A cigarette smoking device having an electronic atomization function, comprising a cigarette holder and an electronic atomization component cooperatively assembled with one another; wherein the cigarette holder comprises a cigarette holding cavity and an optional end cap; the electronic atomization component comprises a shell, wherein the shell includes a power supply, an airflow sensor switch and an atomizer provided with a central airflow channel; the optional end cap is used for closing an open end of the shell when in existence; the cigarette holding cavity is in air communication with the central airflow channel of the atomizer; the cigarette smoking device further comprises an airflow sensor switch air inlet penetrating the shell and/or the optional end cap of the cigarette holder, the airflow sensor switch air inlet is in air communication with the central airflow channel of the atomizer through the airflow sensor switch.

2. The cigarette smoking device having the electronic atomization function according to claim 1, wherein the shell is divided into two cavities, wherein a first cavity accommodates the atomizer, and a second cavity accommodates the power supply and the airflow sensor switch; wherein the atomizer comprises an electric heating wire, a liquid storing cavity for storing a liquid to be atomized, and a liquid guiding device for guiding the liquid to be atomized to the electric heating wire.

3. The cigarette smoking device having the electronic atomization function according to claim 2, wherein the electric heating wire is located in the central airflow channel; independently, the liquid guiding device is a liquid guiding rope or a liquid guiding pipe.

4. The cigarette smoking device having the electronic atomization function according to claim 1, wherein the cigarette holding cavity of the cigarette holder is provided with a variable-diameter holding device therein to hold cigarettes with variable diameters, wherein the variable-diameter holding device is selected from a group consisting of a plurality of overlapping washers successively reduced in diameter from an opening of the cigarette holding cavity, a spring clamping head, and a multiple-jaw chuck holder.

5. The cigarette smoking device having the electronic atomization function according to claim 2, wherein the airflow sensor switch air inlet is located on a side surface or an end surface of a portion of the shell surrounding the second cavity.

6. The cigarette smoking device having the electronic atomization function according to claim 1, the airflow sensor switch and the atomizer are both electrically connected to the power supply, an electric connection way therebetween enables the airflow sensor switch to control the atomizer to be electrified or not.

7. The cigarette smoking device having an electronic atomization function according to claim 2, wherein the cigarette holding cavity of the cigarette holder is provided with a variable-diameter holding device therein to hold cigarettes with variable diameters, wherein the variable-diameter holding device is selected from a group consisting of a plurality of overlapping washers successively reduced in diameter from an opening of the cigarette holding cavity, a spring clamping head, and a multiple-jaw chuck holder.

8. The cigarette smoking device having an electronic atomization function according to claim 1, the airflow sensor switch and the atomizer are both electrically connected to the power supply, an electric connection way therebetween enables the airflow sensor switch to control the atomizer to be electrified or not.

9. A method for improving cigarette smoking quality, comprising:

mixing a mainstream smoke generated by an end-lighting cigarette, a dilution air and an atomization vapor to form a mixture; and smoking the mixture;

wherein the method is realized by using a cigarette smoking device having an electronic atomization function, wherein the cigarette smoking device comprising a cigarette holder and an electronic atomization component cooperatively assembled with one another; wherein the cigarette holder comprises a cigarette holding cavity and an optional end cap; the electronic atomization component comprises a shell and the following components located in the shell: a power supply, an airflow sensor switch and an atomizer provided with a central airflow channel; the optional end cap is used for closing an open end of the shell when in existence; the cigarette holding cavity is in air communication with the central airflow channel of the atomizer; the cigarette smoking device further comprises an airflow sensor switch air inlet penetrating the shell and/or the optional end cap of the cigarette holder, the airflow sensor switch air inlet is in air communication with the central airflow channel of the atomizer through the airflow sensor switch.

10. The method for improving the cigarette smoking quality according to claim 9, wherein the mainstream smoke is mixed with the dilution air and the atomization vapor after leaving the end-lighting cigarette; wherein the atomization vapor contains one or more selected from the group consisting of a flavoring substance, a traditional Chinese medicine extract and a humectant.

11. The method for improving the cigarette smoking quality according to claim 9, wherein the atomizer evaporates a liquid to be atomized in a temperature range of 150° C. to 350° C. to obtain the atomization vapor.

12. The method for improving the cigarette smoking quality according to claim 9, wherein the shell is divided into two cavities, wherein the first cavity accommodates the atomizer, and the second cavity accommodates the power supply and the airflow sensor switch; the atomizer comprises an electric heating wire, a liquid storing cavity for storing a liquid to be atomized, and a liquid guiding device for guiding the liquid to be atomized to the electric heating wire.

13. The method for improving the cigarette smoking quality according to claim 9, wherein the electric heating wire is located in the central airflow channel; independently, the liquid guiding device is a liquid guiding rope or a liquid guiding pipe.

14. The method for improving the cigarette smoking quality according to claim 9, wherein the cigarette holding cavity of the cigarette holder is provided with a variable-diameter holding device therein to hold cigarettes with variable diameters, wherein the variable-diameter holding device is selected from a group consisting of a plurality of overlapping washers successively reduced in diameter from an opening of the cigarette holding cavity, a spring clamping head, and a multiple-jaw chuck holder.

15. The method for improving the cigarette smoking quality according to claim 9, wherein the airflow sensor switch air inlet is located on a side surface or an end surface of a portion of the shell surrounding the second cavity.

* * * * *